US005803241A

United States Patent [19]

Capurso

[11] Patent Number: 5,803,241

[45] Date of Patent: Sep. 8, 1998

[54] PUSH-BUTTON MECHANISM FOR PLUNGER-TYPE ELECTRICAL SWITCH

[75] Inventor: Robert G. Capurso, Bergen, N.Y.

[73] Assignee: Eastman Kodak Company, Rochester, N.Y.

[21] Appl. No.: 872,092

[22] Filed: Jun. 10, 1997

Related U.S. Application Data

[63] Continuation of Ser. No. 655,365, May 30, 1996, abandoned.

[51] Int. Cl.[6] ..... H01H 13/70

[52] U.S. Cl. ..... 200/345; 200/341; 200/330

[58] Field of Search ..... 700/345, 341, 700/331, 517, 529, 573, 293, 293.1, 289, 226, 330

[56] References Cited

U.S. PATENT DOCUMENTS

| | | | |
|---|---|---|---|
| 3,839,614 | 10/1974 | Saganowski et al. | 200/293.1 |
| 3,969,599 | 7/1976 | Terry | 200/153 T |
| 4,303,815 | 12/1981 | Ishikawa | 200/345 |
| 4,357,511 | 11/1982 | Tenner et al. | 200/314 |
| 4,939,383 | 7/1990 | Tucker et al. | 307/139 |
| 5,032,698 | 7/1991 | Satoh | 200/345 |
| 5,132,498 | 7/1992 | Lee | 200/529 |
| 5,343,007 | 8/1994 | Roeser et al. | 200/296 |
| 5,577,601 | 11/1996 | Chung et al. | 200/331 |

*Primary Examiner*—David J. Walczak
*Attorney, Agent, or Firm*—Walter S. Stevens

[57] ABSTRACT

A push-button mechanism for plunger-type electrical switches of the type having a push rod actuator, is provided with a base unit having a pair of undercut tabs. A button member has a pair of heels respectively receivable in the undercut of the tabs for sliding movement of the button to move the push rod actuator to thereby change state of the switch. The button member is retained to the base unit by snap-fit between the heels and the tab undercuts. The switch has a pair of flanges; and the base unit has a pair of tapered slots respectively aligned with the flanges and adapted to releasably receive the flanges upon assembly of the switch to the base unit. The push rod actuator has a recess; and the button member has a pair of opposed ribs aligned with the recess and adapted to be received by the recess upon assembly of the switch to the base unit.

4 Claims, 1 Drawing Sheet

PUSH-BUTTON MECHANISM FOR PLUNGER-TYPE ELECTRICAL SWITCH

This is a Continuation of application Ser. No. 08/655,365, filed 30 May 1996, now abandoned.

BACKGROUND OF THE INVENTION

1. Field of the Invention

The present invention relates to plunger-type electrical switches, sometimes called push-push switches; and more particularly, to a push-button mechanism for mounting and activating such switches.

2. Background Art

Plunger-type electrical switches are commercially available in which a push rod is axially slidable. Upon each depression of the push rod, the switch changes state. A pair of metal flanges with tapped holes extend laterally off the switch, and are commonly used with screws to attach the switch to a panel. Generally, a cosmetic button is provided over the push rod.

Plunger-type electrical switches of the type described have been extensively used with considerable success. However, they are not easily assembled to the panel, as tools are required for attachment and replacement. The cosmetic buttons are usually loose and not self-retained on the panel; producing the risk of loss during switch replacement.

DISCLOSURE OF THE INVENTION

It is an object of the present invention to provide a push-button mechanism for plunger-type electrical switches that provides for easy assembly and replacement of the switch to a panel without mounting screws or other separate connectors.

It is another object of the present invention to provide such a mechanism that allows snap-in and tool-less assembly of all parts.

It is still another object of the present invention to provide such a mechanism which remains attached to the panel during replacement of the switch.

In accordance with these and other objects, a push-button mechanism for plunger-type electrical switches, of the type having a push rod actuator, is provided with a base unit having a pair of undercut tabs. A button member has a pair of heels respectively receivable in the undercut of the tabs for sliding movement of the button to move the push rod actuator to thereby change state of the switch. The button member is retained to the base unit by snap-fit between the heels and the tab undercuts.

According to a preferred embodiment of the present invention, the switch has a pair of flanges; and the base unit has a pair of tapered slots respectively aligned with the flanges and adapted to releasably receive the flanges upon assembly of the switch to the base unit.

According to another embodiment of the present invention, the push rod actuator has a recess; and the button member has a rib aligned with the recess and adapted to be received by the recess upon assembly of the switch to the base unit. According to yet another embodiment of the present invention, the button member has a pair of opposed ribs aligned with the recess and adapted to be received by the recess upon assembly of the switch to the base unit.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
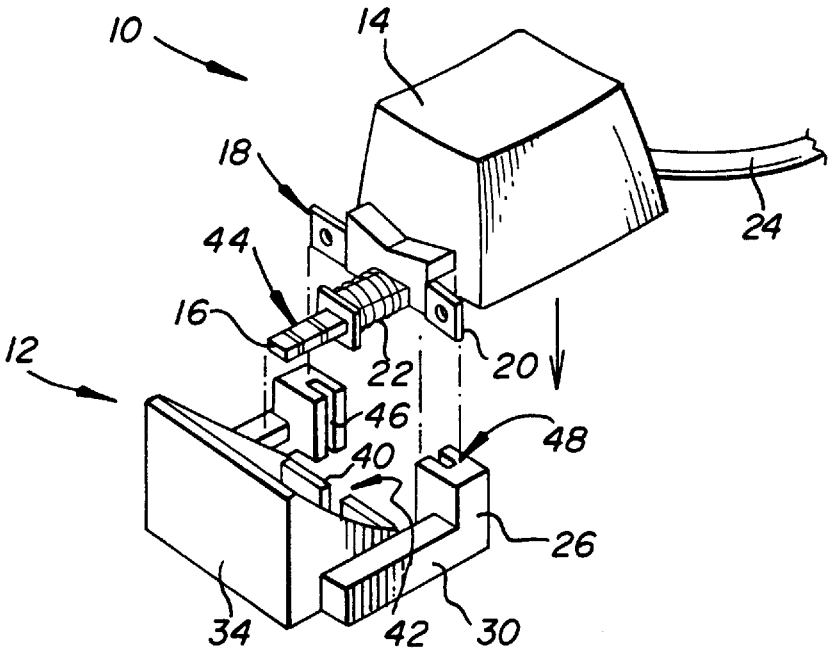
FIG. 1 is a perspective exploded view of a push-button mechanism according to the present invention, together with a plunger-type electrical switch known in the prior art.

FIG. 1 shows a conventional, commercially available plunger-type electrical switch 10 suitable for use with the push-button mechanism 12 of the preferred embodiment of the present invention. Switch 10 includes a housing 14, a push rod 16, and a pair of metal flanges 18 and 20.

Push rod 16 slides axially into housing 14 such that the switch changes state with each depression of the push rod against the force of a spring 22.

Flanges 18 and 20 extend laterally, and each flange has a tapped hole which, in conventional mounting configurations, is used to attach the switch to a control panel by way of a screw. An electrical cable 24 connects the switch to its circuit.

Figure 2:
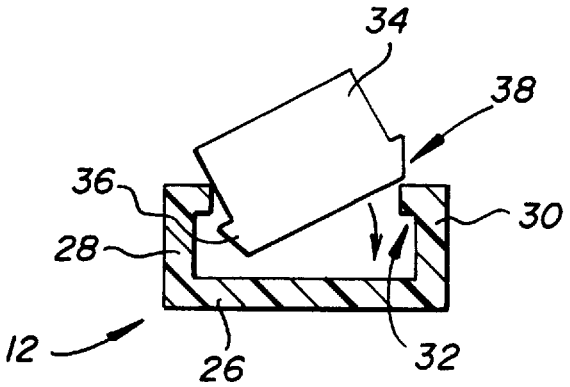
FIG. 2 is an end view, partially in section, showing the assembly process of the push-button mechanism of FIG. 1.

The housing is provided with a base unit 26 that includes a pair of tabs 28 and 30 that, as best seen in FIG. 2, are undercut at 32 to form a channel. A button 34 has a pair of tapered heels 36 and 38 which snap into undercuts 32 of tabs 28 and 30 during assembly. Once assembled, button 34 is self-retained in the base unit 26 with freedom to move along tabs 28 and 30.

Button 34 has a pair of ribs 40 and 42 which form a slot therebetween. During assembly of switch 10 into the base unit, one of a plurality of recesses 44 in push rod 16 mate with ribs 40 and 42 to secure the push rod to button 34. At the same time, flanges 18 and 20 enter a pair of tapered slots 46 and 48 in the base unit to releasably retain switch housing 14.

After assembly, the state of switch 10 may be changed by finger pressure on button 34. The button and push rod 16 move toward switch housing 14.

Should switch 10 need to be replaced, it can easily be removed from base unit 26 simply by lifting the switch housing 14 to withdraw flanges 18 and 20 from slots 46 and 48 and to remove push rod 16 from ribs 40 and 42. No tools are required, and button 34 is self-retained in base unit 26.

The invention has been described in detail with particular reference to preferred embodiments thereof, but it will be understood that variations and modifications can be effected within the spirit and scope of the invention.

PARTS LIST

10 plunger-type electrical switch
12 push-button mechanism
14 housing
16 push rod
18 flange

20 flange
22 spring
24 cable
26 base unit
28 tab
30 tab
32 undercut
34 button
36 heel
38 heel
40 rib
42 rib
44 recesses
46 slot
48 slot

What is claimed is:

1. A push-button mechanism for plunger-type electrical switches of the type having a housing and a push rod actuator movable relative to the housing in an actuation direction, said mechanism comprising:

a base unit having means for connecting the base unit to the switch housing such that relative movement in the actuation direction between the base unit and the switch housing is prevented, said push rod actuator having a recess, and a pair of undercut tabs; and a button member having a pair of heels respectively receivable in the undercut of the tabs for sliding movement of the button relative to the base unit in the actuation direction to move the push rod actuator to thereby change state of the switch, said button member being retained to the base unit by snap-fit between the heels and the tab undercuts, said button member having a rib aligned with the recess and adapted to be removably received by the recess upon assembly of the switch to the base unit.

2. A push-button mechanism as set forth in claim 1 wherein said connecting means includes:

a pair of flanges on the switch; and a pair of tapered slots on the base unit respectively aligned with the flanges and adapted to releasably receive the flanges upon assembly of the switch to the base unit.

3. A push-button mechanism as set forth in claim 1 wherein:

said push rod actuator has a recess; and said button member has a pair of opposed ribs aligned with the recess and adapted to be removably received by the recess upon assembly of the switch to the base unit.

4. A push-button mechanism for plunger-type electrical switches of the type having a housing with a pair of fixed flanges, a push rod actuator movable relative to the housing and the flanges, and a recess in the actuator; said mechanism comprising:

a base unit having a pair of tapered slots respectively aligned with the flanges and adapted to releasably receive the flanges upon assembly of the switch to the base unit such that the base unit is fixed relative to the housing; and a button member having a rib aligned with the recess and adapted to be removably received by the recess upon assembly of the switch to the base unit such that, after assembly, movement of the button member effects movement of the push rod actuator relative to the base unit and the housing to thereby change state of the switch.

* * * * *